US012404760B2

(12) United States Patent
Rinas et al.

(10) Patent No.: US 12,404,760 B2
(45) Date of Patent: Sep. 2, 2025

(54) METHODS OF IMPROVED CAVERN RUBBLIZATION FOR ENHANCED POTASH RECOVERY

(71) Applicant: The Mosaic Company, Plymouth, MN (US)

(72) Inventors: Sheldon Rinas, Regina (CA); Sarah Hornung, Regina (CA); Jason Peters, Moose Jaw (CA); Shayne Lamontagne, Regina Beach (CA); Jason Spring, Regina (CA); Tyler Howard, Moose Jaw (CA)

(73) Assignee: The Mosaic Company, Tampa, FL (US)

( * ) Notice: Subject to any disclaimer, the term of this patent is extended or adjusted under 35 U.S.C. 154(b) by 0 days.

(21) Appl. No.: 17/769,506

(22) PCT Filed: Oct. 15, 2020

(86) PCT No.: PCT/US2020/055786

§ 371 (c)(1),
(2) Date: Apr. 15, 2022

(87) PCT Pub. No.: WO2021/076759

PCT Pub. Date: Apr. 22, 2021

(65) Prior Publication Data

US 2024/0141770 A1 May 2, 2024
US 2025/0223898 A2 Jul. 10, 2025

Related U.S. Application Data

(60) Provisional application No. 62/915,072, filed on Oct. 15, 2019.

(51) Int. Cl.
*E21B 43/28* (2006.01)
*E21B 43/40* (2006.01)

(52) U.S. Cl.
CPC ..... *E21B 43/283* (2013.01); *E21B 43/40* (2013.01)

(58) Field of Classification Search
CPC ..... E21B 43/283; E21B 43/28; E21B 43/40; E21C 41/20
See application file for complete search history.

(56) References Cited

U.S. PATENT DOCUMENTS 4,232,902 A * 11/1980 Cuevas ..... E21C 41/20 299/5
4,305,463 A * 12/1981 Zakiewicz ..... E21B 43/18 166/266

(Continued)

FOREIGN PATENT DOCUMENTS

CN 102112699 B 7/2014
WO WO 2016-057780 A1 4/2016

OTHER PUBLICATIONS

PCT ISR and WOISA for International Application No. PCT/US2020/055786, mailed Jan. 27, 2021, 10 pages.

*Primary Examiner* — Carib A Oquendo
(74) *Attorney, Agent, or Firm* — Husch Blackwell LLP

(57) ABSTRACT

Methods for cavern rubblization for enhanced potash recovery are disclosed. In embodiments, such a method includes pressure cycling. The method can include pressurizing a cavity to maximum flow capacity followed by rapid relief of the cavity pressure. In this embodiment, this cycle of pressurization and rapid relief is repeated several times. Other embodiments of cavern rubblization and methods for enhanced potash recovery, a technique of fluid pulsing is used. According to embodiments, a tool can be used to pulse pressure through clay seams to be wetted. According to both embodiments, these methods increase potash recovery during mining.

16 Claims, 4 Drawing Sheets

(56) References Cited

U.S. PATENT DOCUMENTS

| | | | | |
|---|---|---|---|---|
| 4,398,769 | A | 8/1983 | Jacoby | |
| 5,246,273 | A * | 9/1993 | Rosar | E21B 43/28 175/45 |
| 2009/0236103 | A1 | 9/2009 | Yale et al. | |
| 2009/0309408 | A1* | 12/2009 | Bishop | F16L 9/19 299/5 |
| 2011/0209882 | A1 | 9/2011 | Enis et al. | |
| 2013/0171048 | A1* | 7/2013 | Phillip | E21B 43/28 423/519.2 |

* cited by examiner

| CAVERN | % INCREASE GPL INITIAL | % INCREASE GPL CURRENT | |
|---|---|---|---|
| A | 123.7% | 112.7% | |
| B | 161.0% | 135.6% | |
| C | 115.8% | 108.9% | |
| D | 108.1% | 116.3% | |
| E | 150.5%* | 151.4%* | |
| F | 145.5%* | 150.5%* | |
| G | 152.2%* | 115.9%* | |

* % INCREASE FROM AVERAGE OF GPL INTIAL OF CAVERNS A-D

METHODS OF IMPROVED CAVERN RUBBLIZATION FOR ENHANCED POTASH RECOVERY

PRIORITY CLAIM

The present application is a national phase entry of PCT Application No. PCT/US2020/055786, filed Oct. 15, 2020, which claims the benefit of U.S. Provisional Application No. 62/915,072 filed Oct. 15, 2019, which applications are incorporated herein by reference in their entireties.

FIELD OF THE INVENTION

Embodiments are generally related to the mining of subterranean nutrients. Specifically, the present invention is directed to the use of fluid pulsing and/or pressure cycling through solution injection into an in-ground well or borehole for recovery of potassium chloride or potash.

BACKGROUND OF THE INVENTION

Potash is commercially mined through two methods, conventional underground mining and solution mining. The geology of potash deposits, as depicted in FIG. 1, dictates the method best suited for resource extraction. Conventional mining methods generally have a depth limitation and once potash reserves are deeper than 1200 meters, solution mining must be employed. The solution method of mining targets potash reserves found or encapsulated in sedimentary rocks. Sedimentary rocks tend to collapse when they are dug too deep and often these mines are prone to flooding due to the porosity of the rocks.

Most solution mining involves extracting potash-bearing solutions from flooded underground mines or used well designs which access the potash with vertical boreholes. In the process a salt saturated brine solution is usually used to dissolve and extract potash from existing pillars and surrounding walls of mines and caverns. The existing salt is left largely undisturbed in the underground mining works, which will reduce potential surface disturbance and the creation of sink holes. Once the brine is enriched with potash, the brine is pumped out of the cavern and into surrounding evaporation ponds. The water evaporates, leaving behind salt and potash and the mixture is then removed from the pond and transported to a processing facility where the potash is separated from the salt and refined for sale.

More specifically, the first phase of solution mining is to access a potash reserve. This may be completed with a combination of machines and labor. Often, access is provided through an old conventional potash mine, with a mine pit held up by pillars of potash. Solution mining can extract the remaining potash in the pillars and mine walls. In other cases, there are several steps to solution mining key to forming an underground well/cavity that provides an adequate concentration of potash over its lifespan.

In one method of solution mining, boreholes are drilled to access the sedimentary rock containing potash. The next step is to inject a liquid into the potash bearing rock feeder, which may be a cavern or a borehole, in a series of steps to dissolve enough ore to allow the boreholes to connect and to mine out a sufficient amount of ore to create an adequate underground cavity. Various techniques and equipment are used to enable the flow of fluids into and out of the underground cavity at different elevations to create a desired cavity configuration, as depicted in FIG. 2.

The final stage in cavity development is referred to as "rubble fracturing" or "rubblization." Rubble fracturing involves destabilizing clay seams in order to allow the potash containing ore to fracture and fall into the void that was created below as is depicted in FIGS. 3 and 4. Rubble fracturing increases the surface area of the ore that exposed to the fluid within the cavity. The increased ore surface area increases the rate of the KCl dissolving into the cavity's fluid and also provides access to more of the ore, therefore extending the useful life of the cavity.

Rubble fracturing has historically been performed in two stages: first wetting the clay seams and then forcing a fracture across the wetted clay seams. Wetting the clay seams is typically achieved by modifying downhole piping to allow a hot liquid at a constant pressure to come into contact with the clay seams. The clay absorbs the water naturally and the water continues to migrate though the clay, outwardly from the injection site which reduces the clay's strength. After this process is complete, a pressure is applied across the clay seam in order to force it to separate as depicted in FIG. 5. The success of a rubble fracture can be determined by measuring the KCl concentration coming out of the cavity.

Solution mining offers several advantages compared to conventional underground mining, including lower up-front costs and shorter ramp-up time. Further, overall lead-time for solution mining potash is two to three years less that of conventional mining, which is tied to one location for removal. This flexibility of mining location and extraction also offers reduced engineering risk compared to conventional underground mining.

Though much is known about cavern rubblization and potash recovery, there is still a need for a more efficient and effective method for potash recovery during solution mining.

SUMMARY

Embodiments of the present invention are directed to methods for solution mining of potash. The methods include improved cavern rubblization through pressure cycling and/or cavern rubblization through fluid pulsing.

In one embodiment of the present invention, cavern rubblization through pressure cycling produces a better fracturing of clay seams that need to fail in order to gain access to a large portion of a cavity's potash containing ore. In the improved pressure cycling technique, pressure is applied to the entire cavity by using an available liquid stream to cause it to expand. This step is followed by rapidly releasing the cavity's pressure, causing it to quickly shrink to its original size. This cycled event provides large stresses to the ore body and clay seam, and is repeated until it ultimately causes the fracturing of ore, allowing it to fall to a lower section of the cavity where it can be mined and recovered.

In certain embodiments of the described invention, the method of pressure cycling can be used in combination or without previously used rubble fracturing techniques.

In another embodiment of the present invention, fluid pulsing can be used to wet the clay seams of the mine. In this particular embodiment, this method allows the clay seam to be wetted out further past the injection point. To achieve this, a commercially available fluid pulsing tool is lowered into the well casing to the targeted clay seam and is utilized for the entire pressure cycling process. In a particular embodiment of the proposed invention, the method of potash mining utilizes a mechanical tool to create a pulsing effect of water against the clay seam. This pulsing of pressure ripples through the clay seam that is to be wetted and enhances the wetting of a clay seam during the process of solution mining. After water migration has wetted the clay seam, it has also been found that a differential pressure across the clay seam is no longer required.

In embodiments of the present invention, pressure cycling may be used alone or in combination with conventional rubblization fracturing practices. In an alternative embodiment of the invention, solution mining techniques incorporate a sequence of pressure cycling in the cavity to increase the amount of ore rubblization.

The above summary is not intended to describe each illustrated embodiment or every implementation of the subject matter hereof. The figures and the detailed description that follow more particularly exemplify various embodiments.

BRIEF DESCRIPTION OF THE DRAWINGS

Subject matter hereof may be more completely understood in consideration of the following detailed description of various embodiments in connection with the accompanying figures, in which.

Figure 1:
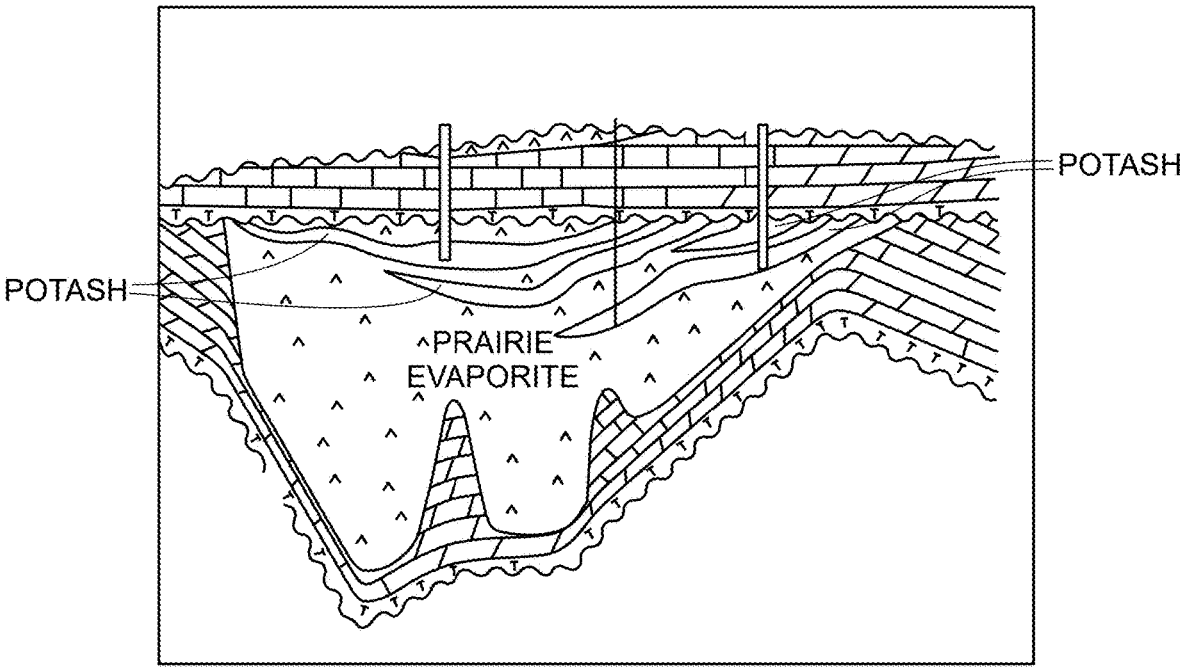
FIG. 1 is a diagram depicting depth comparisons of potash ore.

While various embodiments are amenable to various modifications and alternative forms, specifics thereof have been shown by way of example in the drawings and will be described in detail. It should be understood, however, that the intention is not to limit the claimed inventions to the particular embodiments described. On the contrary, the intention is to cover all modifications, equivalents, and alternatives falling within the spirit and scope of the subject matter as defined by the claims.

DETAILED DESCRIPTION OF THE DRAWINGS

Figure 6:
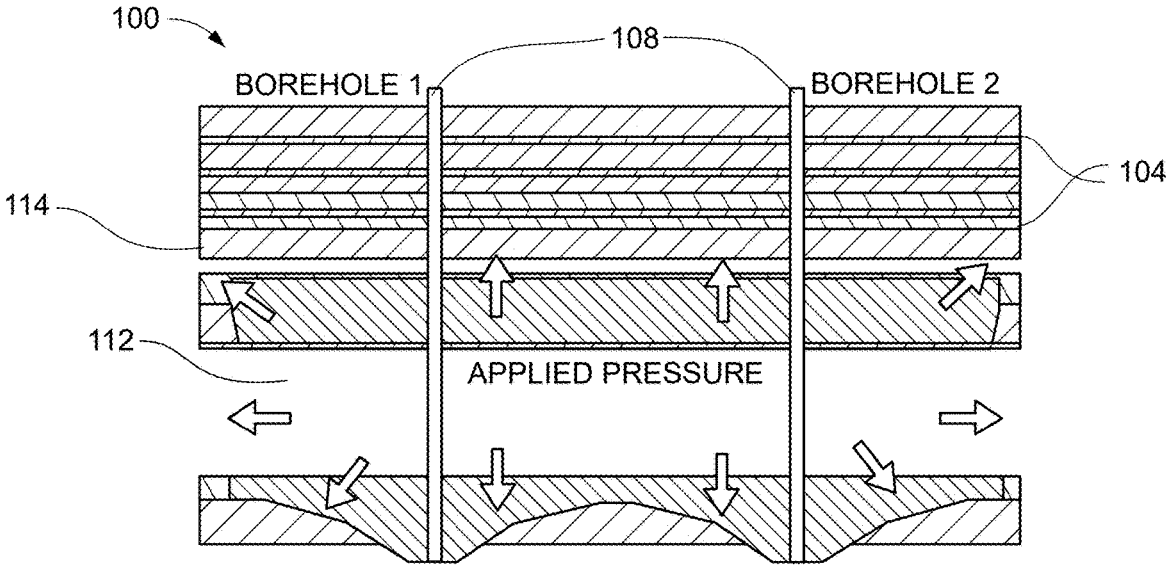
FIG. 6 is a diagram depicting a cavity subjected to pressure expansion according to a method of the present invention.
Figures 7, 8:
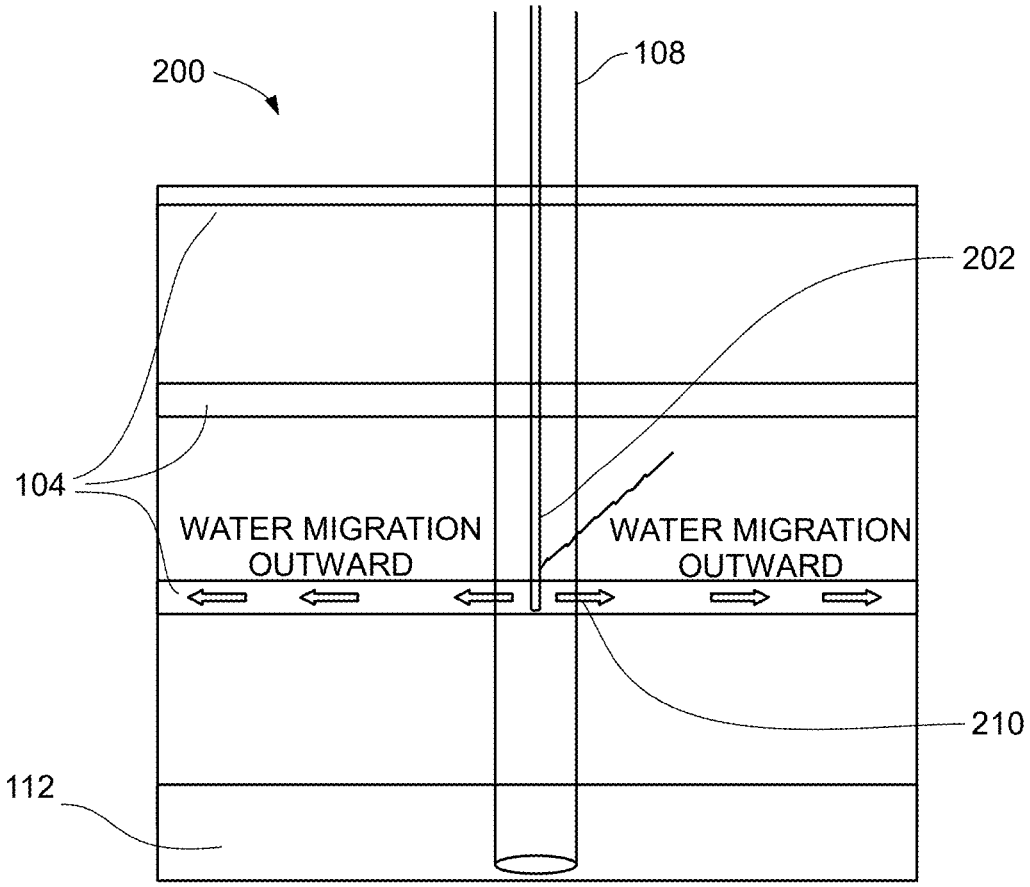
FIG. 7 is a table depicting a potash recovery in percent increase of grams per liter according to a method of the present invention.
FIG. 8 is a diagram depicting a cavity subjected to fluid pulsing according to a method of the present invention.

According to embodiments of a method for increased cavern rubblization for enhanced potash recovery illustrated in FIGS. 6 and 8, wells or boreholes 108 are connected to a cavity 112 containing ore. According to some embodiments, clay seams 104 are present in cavity 112. According to embodiments of the invention, cavern rubblization for enhanced potash recovery can comprise pressure cycling 100, as depicted in FIG. 6, and/or fluid pulsing 200, as depicted in FIG. 8.

According to one embodiment of a method of cavern rubblization for enhanced potash recovery as depicted in FIG. 6, a technique of pressure cycling 100 can be used. According to one embodiment of this method, wells 108 are pressurized to above typical operating pressures using available production streams. Pressurization of wells 108 causes cavity 112 to expand as depicted in FIG. 6. According to an embodiment of the method, pressure of cavity 112 is then stabilized. After pressure stabilization, pressure in cavity 112 is relieved out of well 108 as quickly as possible, allowing cavity 112 to collapse inward as the pressure holding cavity 112 in expansion is removed. According to an embodiment of the method, the rapid collapse of cavity 112 destabilizes clay seams 104, allowing additional ore 114 to fall into a void below. According to embodiments of this method, several cycles of pressurizing and depressurizing well 108 can be performed to achieve desired ore rubblization.

FIG. 7 depicts potash recovery amounts in percent (%) change in grams per liter according to embodiments. This figure illustrates the results of potash recovery using pressure cycling according to embodiments of the method. Pressure cycling was experimentally performed on four wells currently in production, A, B, C, D, and on three new wells, E, F, and G. Results of using pressure cycling according to embodiments of the method indicate that on wells currently in potash production, the use of pressure cycling increased potash recovery. Potash recovery on new potash wells was also increased in caverns E and F (based on average of A-D before pressure cycling), and potash recovery in cavern G was a confirmed wipe liner.

According to embodiments, the method of pressure cycling may be used in combination with methods of traditional rubblization fracturing practices described above. In alternative embodiments, the method of pressure cycling is not used in combination with methods of traditional rubblization fracturing practices.

According to an embodiment of a method of cavern rubblization for enhanced potash recovery as depicted in FIG. 8, a technique of fluid pulsing 200 may be used. The method of fluid pulsing 200 uses tool 202 capable of generating mechanical pulses to aid in wetting of clay seams 104 according to embodiments. According to one embodiment of the technique depicted in FIG. 8, the method comprises a technique of fluid pulsing 200 using a tool 202 that allows clay seams 104 to be wetted out further past injection point 206.

Figure 2:
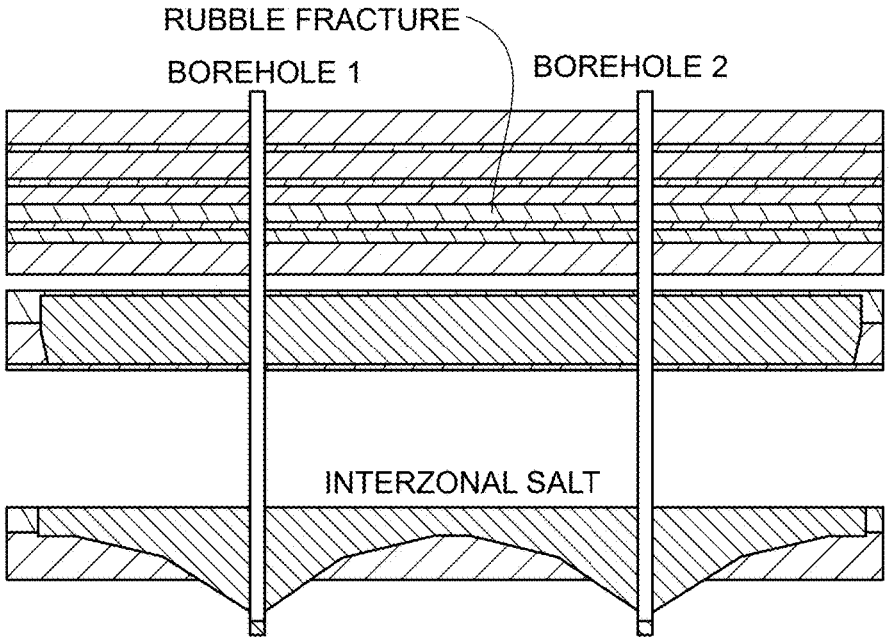
FIG. 2 is a diagram depicting cavity development configuration in solution mining.
Figure 3:
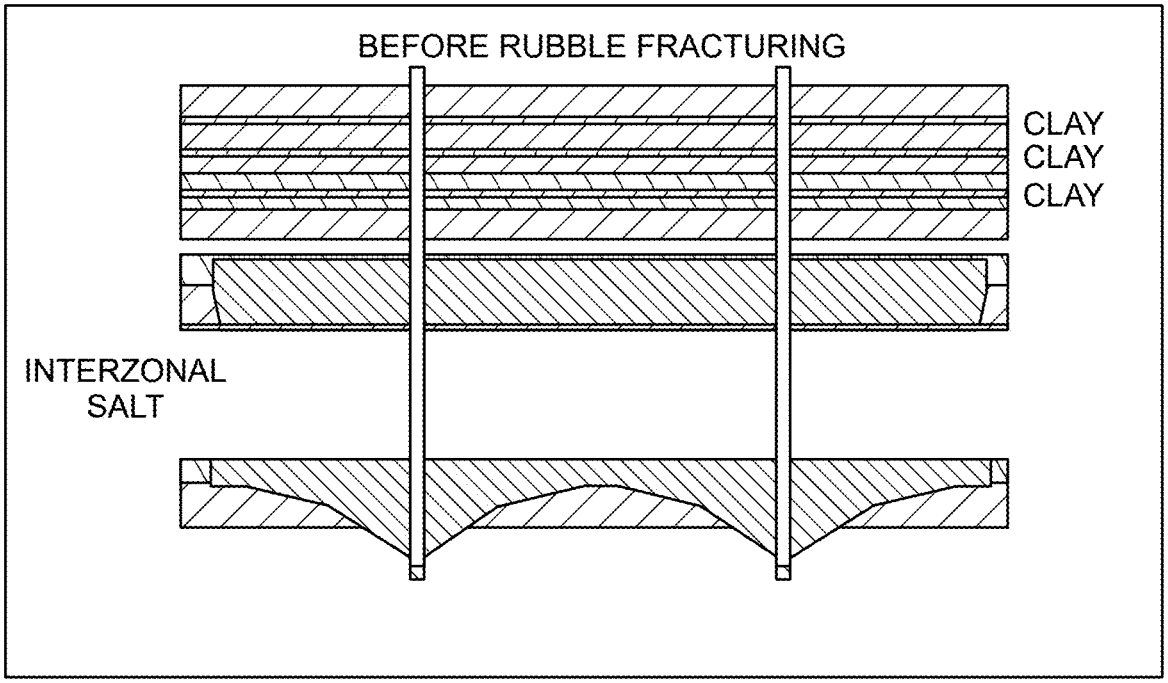
FIG. 3 is a diagram depicting cavity configuration before rubble fracturing.
Figure 4:
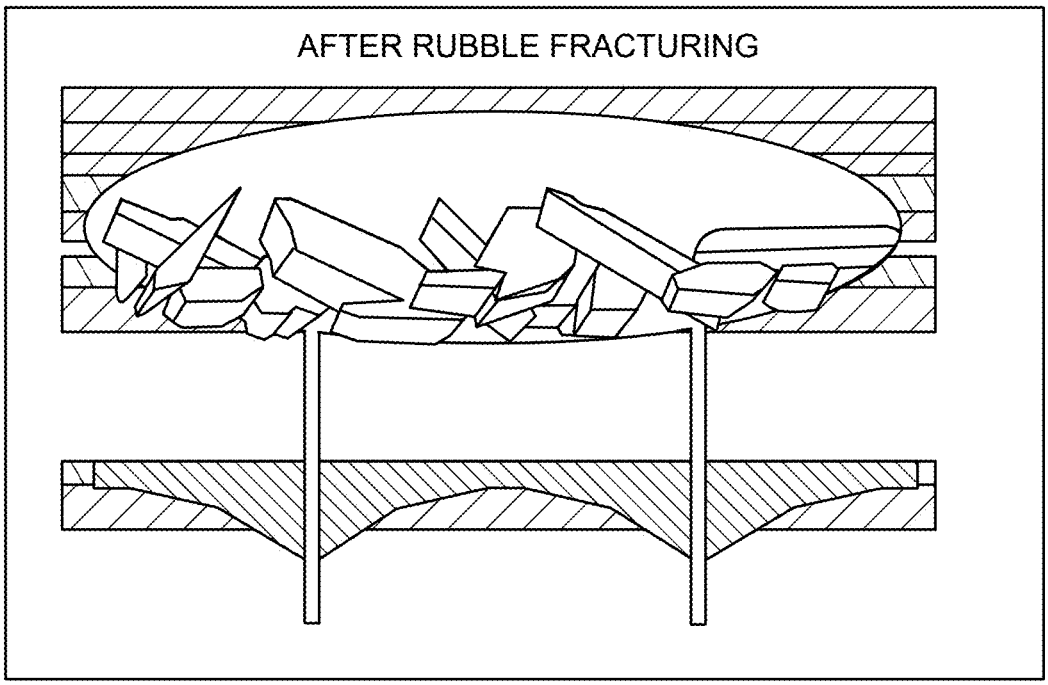
FIG. 4 is a depicting cavity configuration after rubble fracturing.
Figure 5:
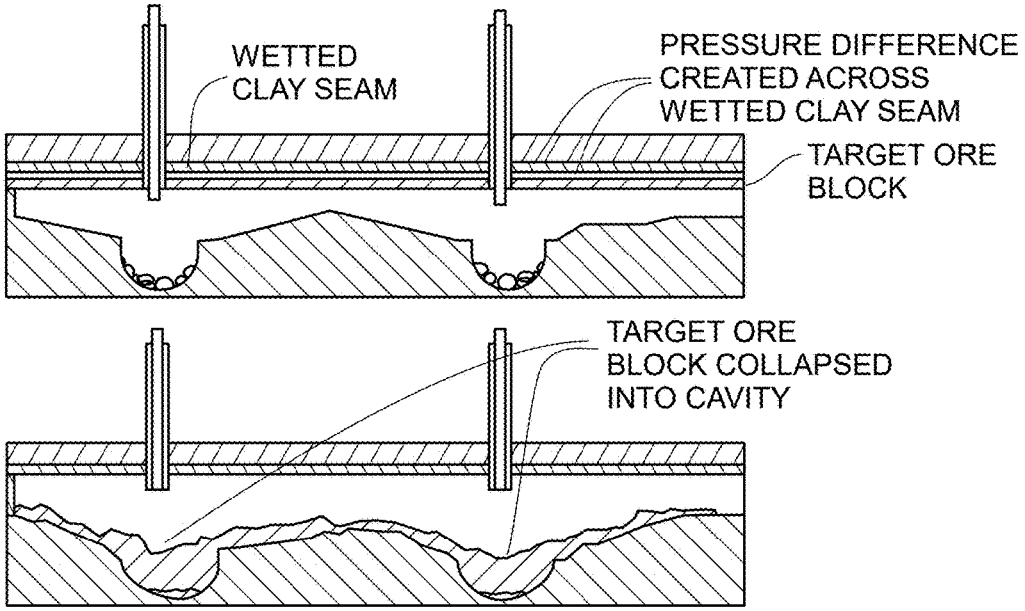
FIG. 5 is a diagram depicting cavity configuration before and after pressure is applied to clay seams to achieve rubble fracturing with the cavity.

In this embodiment, a cavity 112 is first developed according to traditional solution mining cavity development methods as described above. According to embodiments various techniques and equipment are used to enable the flow of fluids into and out of cavity 112 at different elevations to create the desired cavity configuration as depicted in FIG. 2. The final stage of cavity development is rubble fracturing.

In the method of rubble fracturing according to embodiments of the invention depicted in FIG. 8, tool 202 is lowered into well 108 to the targeted clay seam and is supplied with full system pressure. Tool 202 provides a pulsing of pressure that ripples through clay seams 104 that is to be wetted. According to embodiments, wetting clay seam 104 is achieved by modifying downhole piping to allow liquid or fluid at a constant pressure to come into contact with clay seams 104. In the most preferred embodiment, targeted pressure exerted from tool 202 ceases after clay seam 104 is wetted to the point of fracture. In other embodiments pressure exerted from tool 202 may apply pressure to clay seam 104 until fracture occurs.

According to the embodiment depicted in FIG. 8, water migrates outward from injection site 210 and is absorbed by clay seam 104. Increased absorption of water by clay seam 104 reduces the clay's strength by dissolving any salts within the clay and by the swelling effect of water saturated clay. After water migration has wetted the clay seam, cavity 112 is pressurized to typical operating pressures for clay seam 104 fracturing to occur.

According to some embodiments of methods of cavern rubblization for enhanced potash recovery, fluid pulsing 200 may be used in combination with pressure cycling 100. In an alternative embodiment, fluid pulsing 200 is not used in combination with pressure cycling 100. In even other embodiments fluid pulsing 200 is used with traditional methods of cavern pressurization.

Success of this tool has also been measured as above normal potash mining immediately after and over the remaining life of the cavity, signifying that an increased amount of potash was fractured into the lower zone of the cavity where the mining occurs.

Various embodiments of systems, devices, and methods have been described herein. These embodiments are given only by way of example and are not intended to limit the scope of the claimed inventions. It should be appreciated, moreover, that the various features of the embodiments that have been described may be combined in various ways to produce numerous additional embodiments. Moreover, while various materials, dimensions, shapes, configurations and locations, etc. have been described for use with disclosed embodiments, others besides those disclosed may be utilized without exceeding the scope of the claimed inventions.

Persons of ordinary skill in the relevant arts will recognize that the subject matter hereof may comprise fewer features than illustrated in any individual embodiment described above. The embodiments described herein are not meant to be an exhaustive presentation of the ways in which the various features of the subject matter hereof may be combined. Accordingly, the embodiments are not mutually exclusive combinations of features; rather, the various embodiments can comprise a combination of different individual features selected from different individual embodiments, as understood by persons of ordinary skill in the art. Moreover, elements described with respect to one embodiment can be implemented in other embodiments even when not described in such embodiments unless otherwise noted.

Although a dependent claim may refer in the claims to a specific combination with one or more other claims, other embodiments can also include a combination of the dependent claim with the subject matter of each other dependent claim or a combination of one or more features with other dependent or independent claims. Such combinations are proposed herein unless it is stated that a specific combination is not intended.

Any incorporation by reference of documents above is limited such that no subject matter is incorporated that is contrary to the explicit disclosure herein. Any incorporation by reference of documents above is further limited such that no claims included in the documents are incorporated by reference herein. Any incorporation by reference of documents above is yet further limited such that any definitions provided in the documents are not incorporated by reference herein unless expressly included herein.

For purposes of interpreting the claims, it is expressly intended that the provisions of 35 U.S.C. § 112(f) are not to be invoked unless the specific terms "means for" or "step for" are recited in a claim.

What is claimed is:

1. A method for recovery of potash from sedimentary rock, the method comprising:

providing first and second bore holes in fluid communication with a cavity defined by walls containing ore;

injecting a fluid into the first and second bore holes and cavity to pressurize the cavity to produce an operating pressure, wherein the ore is soluble in the fluid;

increasing a pressure of the bore hole and cavity above the operating pressure by injecting fluid into one or more of the bore holes until the cavity cannot take on any more fluid; and rapidly relieving the pressure in cavity via the first and second bore holes, thereby causing the cavity to collapse inwardly.

2. The method of claim 1, wherein the fluid is water or brine.

3. The method of claim 1, wherein increasing the pressure of the bore hold and cavity causes the cavity to expand.

4. The method of claim 1, the method further comprising removing the fluid from the first and second boreholes and cavity, and recovering potash in solution from the fluid.

5. The method of claim 1, further comprising:

repeating the steps of injection of the fluid, increasing the pressure of the bore hole and cavity, and rapidly relieving the pressure, at least two times.

6. The method of claim 1, further comprising:

before the first and second boreholes cavity are pressurized to the operating pressure, subjecting the fluid to fluid pulsing.

7. The method of claim 6, wherein subjecting the fluid to fluid pulsing comprises inserting a tool configured to generate mechanical pulses into one of the first and second boreholes at a location proximate a clay seam in the sedimentary rock, and generating fluid pulses, wherein the fluid penetrates a wall of the first or second borehole to wet the clay seam.

8. The method of claim 1, wherein the recovery of potash increases by at least 10%.

9. A method for recovery of potash from sedimentary rock, the method comprising:

providing first and second bore holes in fluid communication with a cavity containing ore;

injecting a fluid into the first and second bore holes and cavity; and subjecting the fluid to fluid pulsing before removing the fluid by inserting a tool configured to generate mechanical pulses into one of the first and second boreholes at a location proximate a clay seam in the sedimentary rock and generating fluid pulses with the tool, wherein the fluid penetrates a wall of the first or second borehole to wet the clay seam.

10. The method of claim 9, wherein the fluid is water or brine.

11. The method of claim 9, further comprising:

after fluid pulsing, pressurizing the cavity to an operating pressure to fracture the clay seam.

12. The method of claim 11, further comprising:

removing the fluid from the first and second boreholes and cavity, and recovering potash in solution from the fluid.

13. The method of claim 10, further comprising:

after subjecting the fluid to fluid pulsing, subjecting the cavity to pressure cycling.

14. The method of claim 13, wherein subjecting the cavity to pressure cycling comprises:

increasing a pressure of the bore hole and cavity above the operating pressure by injecting fluid until the cavity cannot take on any more fluid; and rapidly relieving the pressure in cavity via the first and second bore holes, thereby causing the cavity to collapse inwardly.

15. The method of claim 14, wherein increasing the pressure and rapidly relieving the pressure is repeated at least two times.

16. The method of claim 9, wherein the recovery of potash increases by at least 10%.

* * * * *